United States Patent [19]

McMillan et al.

[11] 4,351,138

[45] Sep. 28, 1982

[54] ROOF CONSTRUCTION AND METHOD THEREOF

[75] Inventors: William J. McMillan; Jerry L. Severson, both of Newark, Ohio

[73] Assignee: The Dow Chemical Company, Midland, Mich.

[21] Appl. No.: 225,298

[22] Filed: Jan. 15, 1981

Related U.S. Application Data

[63] Continuation of Ser. No. 39,462, May 16, 1979, abandoned.

[51] Int. Cl.[3] ..... E04B 7/00

[52] U.S. Cl. ..... 52/309.4; 52/408; 52/747

[58] Field of Search ..... 52/309.12, 309.9, 408, 52/410, 411, 3, 747, 5, 309.8, 309.4; 405/15, 16, 17

[56] References Cited

U.S. PATENT DOCUMENTS

| | | | |
|---|---|---|---|
| 3,389,518 | 6/1968 | Horbach | 52/309.8 |
| 3,411,256 | 11/1968 | Best | 52/309.8 |
| 3,455,076 | 7/1969 | Clarvoe | 52/309.8 |
| 3,619,961 | 11/1971 | Sterrett | 52/302 |
| 3,774,364 | 11/1973 | Johnson | 52/23 |
| 3,862,527 | 1/1975 | Peterson | 52/302 |
| 4,045,934 | 9/1977 | Sheahan | 52/309.4 |
| 4,235,058 | 11/1980 | Patry | 52/408 |

*Primary Examiner*—John E. Murtagh
*Attorney, Agent, or Firm*—R. B. Ingraham

[57] ABSTRACT

In a roof wherein the roof has a water impermeable membrane disposed on a roof deck and a closed cell insulation material disposed over the membrane, individual blocks of insulating material are tied together by a water permeable sheet such as a scrim to permit floating of the insulation and a protective layer disposed thereon in the event of ponding.

10 Claims, 4 Drawing Figures

ROOF CONSTRUCTION AND METHOD THEREOF

Cross Reference to Related Application

Figure 1:
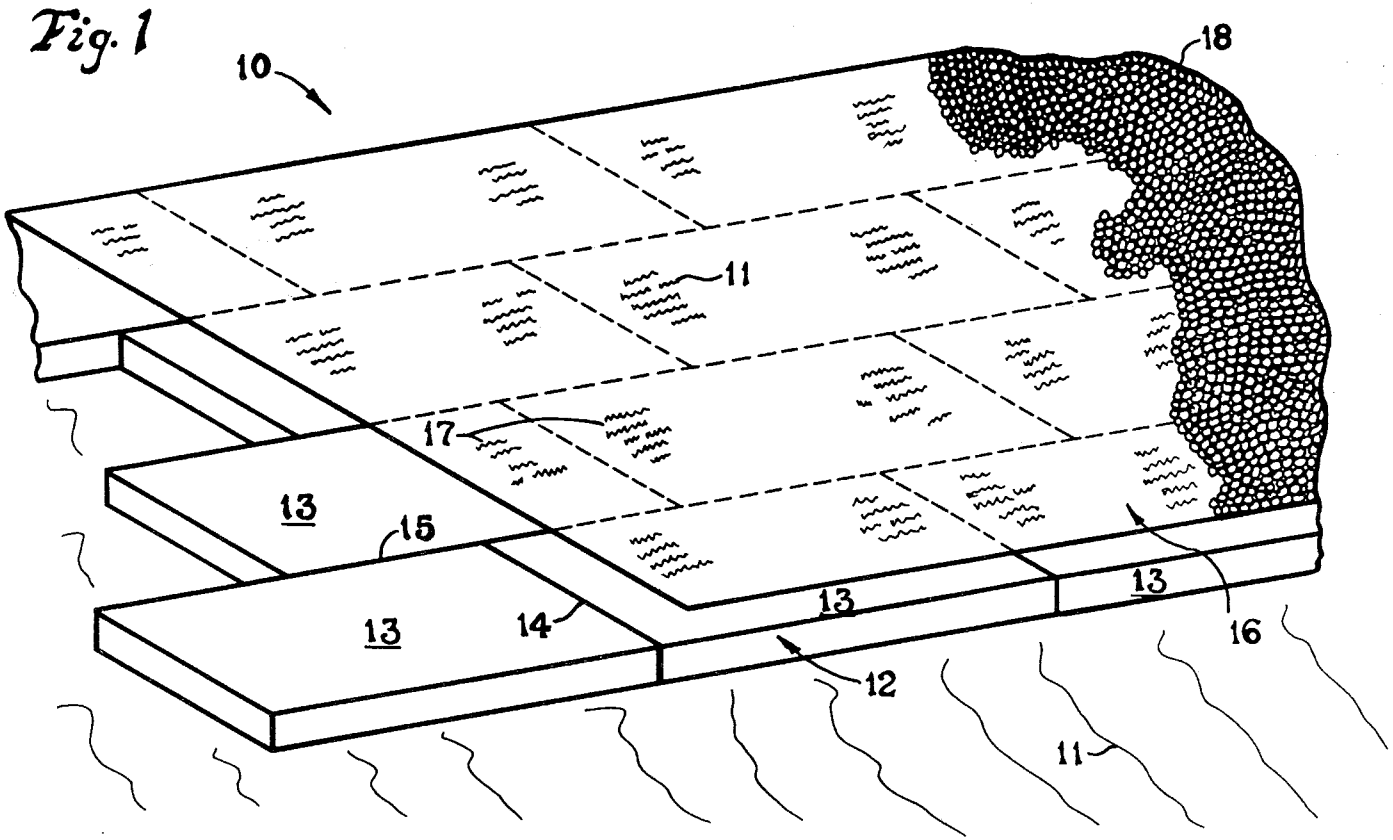

This is a continuation of application Ser. No. 39,462, filed May 16, 1979, now abandoned.

For many years a so-called flat roof has been popular for many applications, as it can be installed at relatively low cost.

A substantial improvement was made in such roofing and is set forth in U.S. Pat. No. 3,411,256. A similar roof is set forth in U.S. Pat. No. 3,763,614, and in the teaching of the foregoing cited patents is herewith incorporated by reference thereto. Such roofs generally comprise a roof deck having a water impermeable membrane. For example, a plurality of layers of asphalt and roofing felt is applied to provide a membrane of desired thickness, closed cell insulating foam bodies or planks are disposed upon the water impermeable membrane. A plurality of fissures are defined between the closed cell foam insulating members, and a protective layer such as gravel is disposed on top of the insulating material. Such roofs in most installations have been very successful in that the thermal insulation disposed over the water impermeable membrane reduces significantly the maximum temperature reached by the roof membrane and delays deterioriation of the roof membrane from exposure to sunlight and severe thermal cycling. Occasionally such roofs are applied to roof decks which are not flat but have depressed areas where water may collect. If such depressed areas are sufficiently large, a considerable force may be exerted by the insulation on the membrane when the water has collected in these areas and tends to cause the closed cell thermal insulation to float and in some areas where there is insufficient adhesion between the membrane and closed cell foam insulating members, the insulating members have been dislodged and smaller gravel particles have worked their way between and/or beneath the insulating member, substantially increasing the difficulty of repair. The phenomenon of ponding is not necessarily present from the time of construction of the roof, but may develop as the building ages so that what may have been an initially satisfactory roof may become, through movement of the structure, such as a sagging structure, an unsatisfactory roof.

It would be desirable if there were available an improved thermally insulated roof and method for the construction thereof.

It would also be desirable if there were an improved roof structure which was resistant to the effects of ponding.

It would also be desirable if there were an improved roof construction wherein the possibility of gravel or other protective material working under the insulating member would be reduced.

It would also be desirable if there were available an improved thermally insulated roof which was easily applied as an original roof or as a re-roof.

These benefits and other advantages in accordance with the present invention are achieved in a roof structure comprising a roof support means having a roof deck, the roof deck having an upper surface and a lower surface, the upper surface of the roof deck supporting a water impermeable membrane, the impermeable membrane having an upper face and a lower face, the lower face being generally adjacent the roof deck; a thermally insulating layer disposed adjacent the upper face of the water impermeable membrane, the thermally insulating layer comprising a plurality of closed cell water impermeable insulating members, the insulating members defining fissures between adjacent members, a coherent water permeable layer disposed over the insulating members, the coherent water permeable layer being affixed to the insulating members.

Also contemplated within the scope of the present invention is a method of preparing a built up roof, the method comprising applying and affixing to a roof deck a water impermeable membrane, disposing on the water impermeable membrane a plurality of closed cell water impermeable thermal insulating members which define fissures between adjacent members, applying to the water impermeable insulating members a flexible coherent water permeable web and affixing the web to the insulating members.

Further features and advantages of the present invention will become more apparent from the following specification taken in connection with the drawing.

FIGS. 1–4 schematically depict roofs in accordance with the present invention. In FIGS. 1–4 like numbers are employed to indicate like elements, and in FIGS. 2–4 the elements are distinguished by an alphabetical suffix.

In FIG. 1 there is schematically depicted a fractional view of a roof construction in accordance with the present invention generally designated by the reference numeral 10. The roof structure 10 comprises in cooperative combination a roof deck having disposed thereon a water impermeable membrane, a plurality of closed cell thermally insulating members 13 are disposed in generally edge to edge relationship on the upper surface of membrane 11.

The members 13 are generally rectangular in configuration and form a thermally insulating layer 12 above the water impermeable membrane. The members 13 define fissures such as fissures 14 and 15 between adjacent insulating members 13. Above the layer 12 is a coherent flexible water permeable layer or web which on completion of construction of the roof is generally coextensive with the insulating layer 12. The layer 16 is adhered to the elements 13 at a plurality of locations; some of the locations are indicated by the reference number 17. A protective layer 18 is disposed over the coherent water permeable layer 16. Beneficially the layer 18 is of gravel or the like.

In the FIG. 1, the coherent layer 16 has been affixed to the insulating members 13 by means of a simple heat seal in regions indicated by the reference numeral 17 and the generally zigzag lines. Such a heat seal is readily accomplished by applying heat judiciously from a tool such as a propane torch, or a sealing iron which may be electrically or gas heated.

Figure 2:
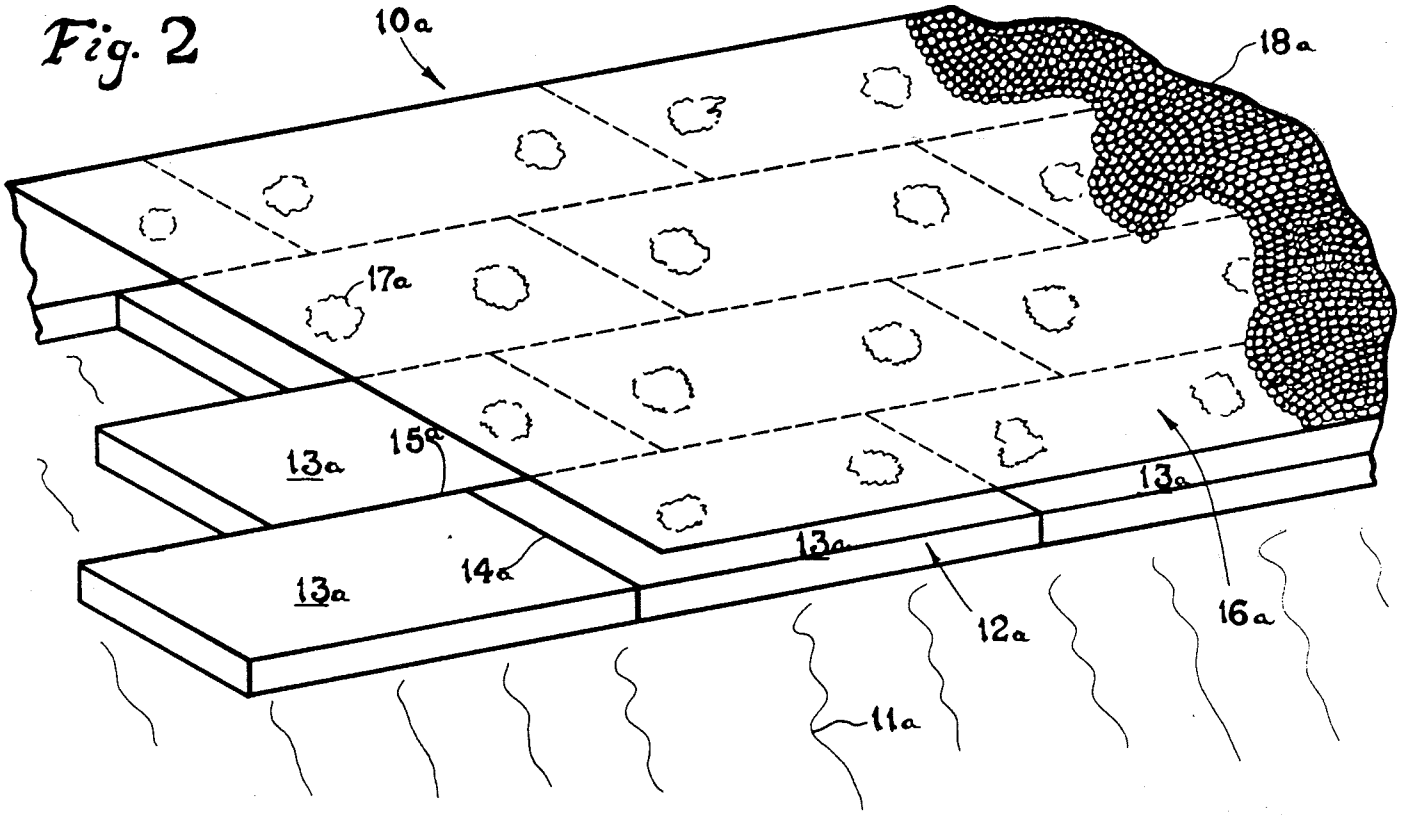

In FIG. 2 there is depicted a partially cutaway view of a roof of generally identical construction to that of FIG. 1 with the exception that the coherent water permeable layer 16 has been affixed to the insulating members 13A by means of a plurality of isolated applications of an adhesive such as is indicated by the reference numeral 17*a*.

Figure 3:
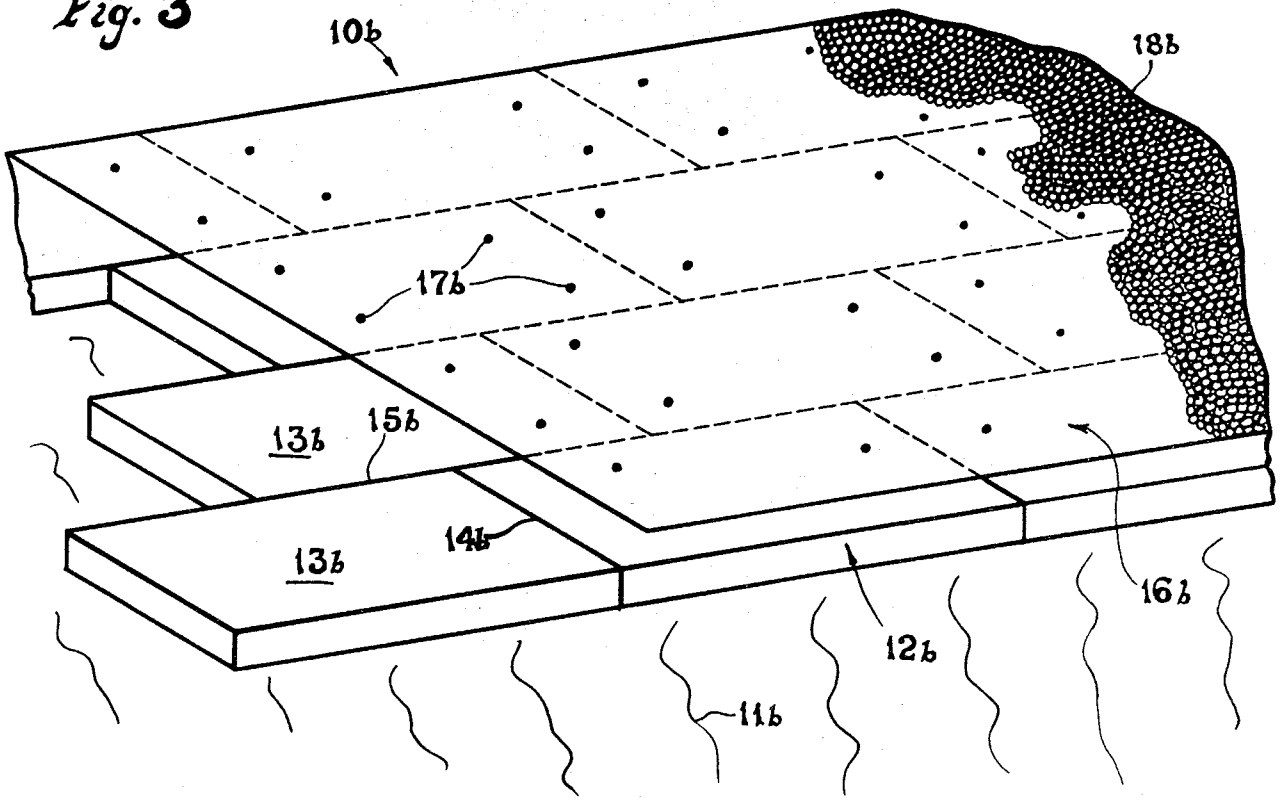

FIG. 3 depicts a roof of generally like construction to that of FIG. 1 with the exception that the coherent water permeable layer is attached to the insulating members 13*b* by a plurality of mechanical fasteners some of which are indicated by the reference numeral 17*b* such as nails, staples, screws and the like.

Figure 4:
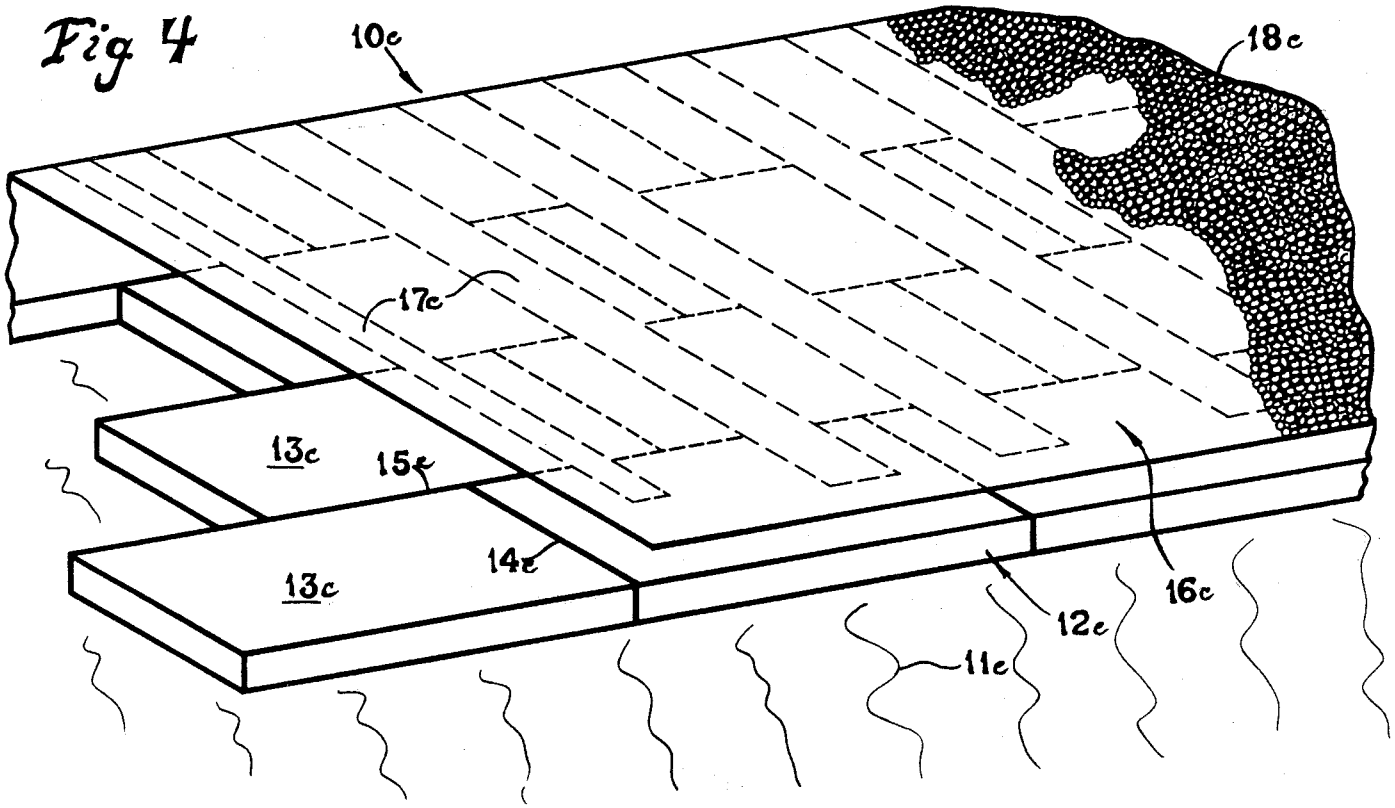

In FIG. 4 there is depicted a partially cutaway view of a roof in accordance with the present invention which is generally identical in construction to that of FIG. 1 with the exception that the coherent water permeable layer 16 is attached to insulating members 13*c* in a plurality of regions indicated by the reference numeral 17*c* wherein strips of hot melt adhesive, for example, an ethylene-vinyl acetate copolymer containing 82 weight percent ethylene and 18 weight percent vinyl acetate and having a thickness of about 3 mils is disposed between the layer 16 and the insulating elements 13*c* and heated, for example, in a hot air gun to a temperature sufficiently high to adhere to both the layer 16 and the members 13*c*.

Advantageously the thermally insulating layer is not joined to the water impermeable membrane. It is essential and critical, to the practice of the present invention, that the insulating layer be of a closed cell configuration. The particular density or physical strength of such an insulating materal need only be sufficient to meet the mechanical demands of the particular installation. Generally, foamed polystyrene sheets having a density of about 1.5 pounds per cubic foot are adequate for roof installations which are not subject to heavy foot traffic. If lower density and lower physical strength closed cell foamed materials are employed as the insulating layer, it is often desirable to provide a protective layer of sufficient strength to resist mechanical damage. Thus, in a region where little or no foot traffic is expected on a roof, a loose gravel coating is applied directly over the closed cell thermal insulated layer and provides adequate protection, however, in regions where frequent or heavy foot traffic occurs, it is often desirable to employ a layer of cementitious material as is obtained from a mixture of portland cement, sand and water or magnesium oxychloride cement and the like.

However, for purposes of insulation when the weather is windy and insulation sheets may be disturbed by the wind, small areas of bituminous material or other adhesive may be employed to maintain planks or sheets of insulating material in position until the coherent membrane can be applied thereto.

It is desirable that the protective layer of the water permeable layer not be resistant to the passage of moisture and in many cases it is desirable that moisture be permitted to contact the water permeable membrane. It is not essential that the protective layer be resistant to the passage of moisture, nor is it essential the insulating layer have a surface which prevents moisture from contacting the water resistant membrane.

Beneficially in the fabrication of a roof, in accordance with the present invention, thermal insulating panels such as planks or sheets or cellular polystyrene or other cellular material are positioned adjacent each other in edge-to-edge relationship and no attempt made to seal the cracks or fissures therebetween. Indeed, in some installations employing incompletely cured or stabilized synthetic resionous foams, shrinkage of the foam occurs, wherein the foam cracks in random patterns similar to mud cracking and mortar on the surface thereof ruptures in a similar pattern. Such cracking does not appear to cause loss of serviceability or desirability of the roof structure.

Roof structures, in accordance with the present invention, do not appear subject to damage by freezing of water in minor spaces between adjacent foam insulating elements. The foam insulating elements appear to have sufficient resilience to resist rupturing by the expansion of freezing water in crevices. Furthermore, in installations on a heated building the temperature adjacent the water resistant membrane usually does not reach freezing temperatures. In buildings having a roof applied in accordance with the present invention, little or no tendency is observed for moisture to condense on the inner surface of the roof deck.

A wide variety of materials may be employed for the coherent flexible water permeable layer such as glass cloth, non-woven synthetic fabrics such as spun bonded polypropylene, nylon and the like; open scrims may be employed. However, for most applications where the roof will be provided with an inorganic particulate layer such as gravel, a closer weave is preferred. If the gravel has not been well sorted as to size, ideally the web of the coherent layer should be such that it does not permit undersize or smaller gravel particles to pass through the coherent layer and lodge between or under the insulating members. One particularly desirable material is a spun bonded polypropylene fabric.

By way of further illustration, a concrete roof deck having bonded to it an asphalt three-ply built up roof membrane is covered with two inch thick foamed polystyrene board 4 feet in length and 2 feet in width. The polystyrene had a density of about 2.2 pounds per cubic foot. The polystyrene boards were arranged generally as depicted in FIG. 1. No adhesive was employed to bond the polystyrene boards to the asphalt felt membrane. An adhesive especially designed for polystyrene foam and commercially sold under the trade designation as DOW MASTIC 11 was applied to the center of each insulation board. The layer of polypropylene fabric sold under the trade designation of TYPAR was 150" in width. It was rolled over the polystyrene foam boards having adhesive thereon and the roof covered with strips of the polypropylene fabric. The strips were overlapped about 6". A protective layer of coarse gravel was then applied over the polypropylene fabric. The gravel layer was applied to provide a layer of 6 pounds of stone per square foot. The roof is found entirely satisfactory.

As indicated in the description of the drawing, a wide variety of means may be employed to attach the foam insulating members to the coherent flexible layer. In the event of ponding, the foam of a roof in accordance with the invention will float and be generally uniformly displaced according to the amount of water in a particular area of the roof and the insulating members in general are not displaced relative to adjacent members.

As is apparent from the foregoing specification, the present invention is susceptible of being embodied with various alterations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

What is claimed is:

1. A roof structure comprising a roof support means having a roof deck, the roof deck having an upper surface and a lower surface, the upper surface of the roof deck supporting a water impermeable membrane, the impermeable membrane having an upper face and a lower face, the lower face being generally adjacent the roof deck; a thermally insulating layer disposed adjacent the upper face of the water impermeable membrane, the thermally insulating layer comprising a plurality of closed cell water impermeable insulating members, the insulating members defining fissures between adjacent members, a coherent water permeable fabric layer disposed over the insulating members, the coherent water permeable layer being affixed to the insulating members, whereby in the event of ponding, the insulating members will float and be generally uniformly displaced according to the amount of water in a particular area of the roof, and the insulating members generally will not displace relative to adjacent members.

2. The roof structure of claim 1 including a protective layer disposed over the water permeable layer.

3. The roof structure of claim 2 wherein the protective layer is gravel.

4. The roof structure of claim 1 wherein the water permeable layer is adhered to the insulating members.

5. The roof structure of claim 1 wherein the water permeable layer is mechanically affixed to the insulating members.

6. The roof structure of claim 1 wherein the fabric is a polypropylene fabric.

7. The method of preparing a built up roof, the method comprising applying and affixing to a roof deck a water impermeable membrane, disposing on the water impermeable membrane a plurality of closed cell water impermeable thermal insulating members which define fissures between adjacent members, applying a water permeable web above the insulating members and affixing the web to the insulating members, whereby in the event of ponding the insulating members will float and be generally uniformly displaced according to the amount of water in a particular area of the roof, and the insulating members generally will not displace relative to adjacent members.

8. The method of claim 7 including the step of disposing a protective layer over the water permeable web.

9. The method of claim 8 including the step of adhering the web to the insulating members.

10. The method of claim 7 including the step of mechanically affixing the web to the insulating members.

* * * * *